US007334270B2

(12) United States Patent
Sato et al.

(10) Patent No.: US 7,334,270 B2
(45) Date of Patent: Feb. 26, 2008

(54) STRAP FOR DIVING FACE MASK

(75) Inventors: Hiromasa Sato, Tokyo (JP); Yuji Kuroda, Tokyo (JP); Minoru Takeuchi, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 81 days.

(21) Appl. No.: 11/338,639

(22) Filed: Jan. 25, 2006

(65) Prior Publication Data

US 2006/0162056 A1 Jul. 27, 2006

(30) Foreign Application Priority Data

Jan. 26, 2005 (JP) ..... 2005-018886

(51) Int. Cl.
*A61F 9/02* (2006.01)

(52) U.S. Cl. ..... 2/452; 351/43

(58) Field of Classification Search ..... 2/2.14, 2/423, 452; 351/43

See application file for complete search history.

(56) References Cited

U.S. PATENT DOCUMENTS 5,329,643 A * 7/1994 Sato ..... 2/428
5,813,056 A * 9/1998 Ambrose ..... 2/452
6,138,287 A * 10/2000 Chou ..... 2/452
6,640,347 B2 * 11/2003 Fukasawa ..... 2/428
7,134,149 B2 * 11/2006 Sato ..... 2/431

FOREIGN PATENT DOCUMENTS

JP 3536004 3/2004

* cited by examiner

*Primary Examiner*—Katherine Moran
(74) *Attorney, Agent, or Firm*—Clark & Brody

(57) ABSTRACT

A strap for diving face mask includes an upper branched sub-section and a lower branched sub-section forming together a loop section in a middle zone of the strap as viewed lengthwise. The upper branched sub-section has a circumferential length larger than a circumferential length of the lower branched sub-section and preferably right and left halves of the strap are sloped toward the side of the lower branched sub-section.

14 Claims, 7 Drawing Sheets

STRAP FOR DIVING FACE MASK

BACKGROUND OF THE INVENTION

The present invention relates to a strap for diving face mask and more particularly to such a strap having a specific configuration as well as a high functionality in a region thereof adapted to come in contact with the occipital region of the wearer's head.

Conventional diving face masks, for example, one of them as disclosed in Japanese Patent Publication No. 3536004 includes a strap to be put about the wearer's head and such strap is provided in its lengthwise middle zone with a loop section adapted to be held in contact with the occipital region of the wearer's head. The loop section comprises an upper branched sub-section and a lower branched sub-section which are symmetric to each other in a vertical direction as well as in a transverse direction.

Such a conventional strap will be described in more detail with reference to FIG. 8 of the accompanying drawings as showing prior art. The strap 100 includes in its lengthwise middle zone a loop section 101. The loop section 101 comprises an upper branched sub-section 102 and a lower branched sub-section 103 which are symmetric to each other about a first central axis y extending in the transverse direction as well as about a second central axis x extending the vertical direction. In other words, the circumferential length of the upper branched sub-section 102 is exactly the same as the circumferential length of the lower branched sub-section 103. The strap 100 linearly extends along the first central axis y over the entire length. Though not shown, the loop section 101 is two-dimensionally flat as viewed in a sectional view of the strap 100 taken in the vertical direction.

In the case of the conventional strap 100 for diving face mask as has been described above, the upper and lower branched sub-sections 102, 103 constituting together the loop section 101 have exactly the same in the circumferential length and this feature causes a problem as will be described below.

In general, the occipital region of human head (the wearer's head) is three-dimensionally curved so as to have a convexity directed backward and a crowning of such convexity is positioned virtually on the horizontal plane passing the wearer's eyes or slightly above this horizontal plane. Assumed now that the wearer's head is divided into upper and lower sections about the crowning, the circumferential length of the lower section is shorter than the circumferential length of the upper section. With the strap 100 put on the head, the upper branched sub-section 102 is positioned on the upper section of the head and the lower branched sub-section 103 is positioned on the lower section of the head. Consequentially, the lower branched sub-section 103 necessarily becomes slack and/or redundant and a good fit to the lower section of the head is not obtained. To overcome such inconvenience, the wearer usually adjusts the fit, for example, by pulling down the lateral sections of the strap 100. However, such fit adjustment may be inadequately effective or effective temporarily.

SUMMARY OF THE INVENTION

It is an object of the present invention to solve the problem of the conventional strap as has been described above by configuring the loop section of the strap with the respective circumferential lengths of the upper and lower branched sub-sections appropriately matching the circumferential lengths of the upper and lower sections of the occipital region of the wearer's head and by three-dimensionally configuring the loop section and thereby to provide the strap improved to be put on the wearer's head with a high stability and high fit.

The present invention is directed to a strap for diving face mask having a first lengthwise axis extending lengthwise, a widthwise axis extending widthwise extending widthwise, an inner side facing the wearer's head, an outer side facing away from the wearer's head, a loop section defined in a middle zone thereof as viewed lengthwise and lateral sections extending lengthwise from both sides of the loop section. The loop section comprises an upper branched sub-section and a lower branched sub-section which are divided by a lengthwise axis while the loop section is bilaterally symmetric with respect to the widthwise axis, wherein the upper branched sub-section has a circumferential length larger than a circumferential length of the lower branched sub-section.

To achieve the object set forth above more reliably, the strap include preferably at least one, more preferably two or more of the features as follows: right and left halves of the strap divided by the widthwise axis slope toward the side of the lower branched sub-section; the inner side facing the wearer's head is concavely curved in the loop section as viewed in a sectional view taken widthwise; the upper branched sub-section and the lower branched sub-section are provided with depressed thinner regions; opposite ends of the loop section are provided with depressed thinner regions; and the strap is elastically stretchable at least lengthwise of lengthwise and widthwise.

The strap for diving face mask according to the present invention improves a stability as well as fit with which the strap is put on the wearer's head, particularly on the occipital region of the wearer's head.

DETAILED DESCRIPTION OF THE PREFERRED EMBODIMENTS

Details of a strap for diving face mask according to the present invention will be more fully understood from the description given hereunder with reference to the accompanying drawings.

Figure 1:
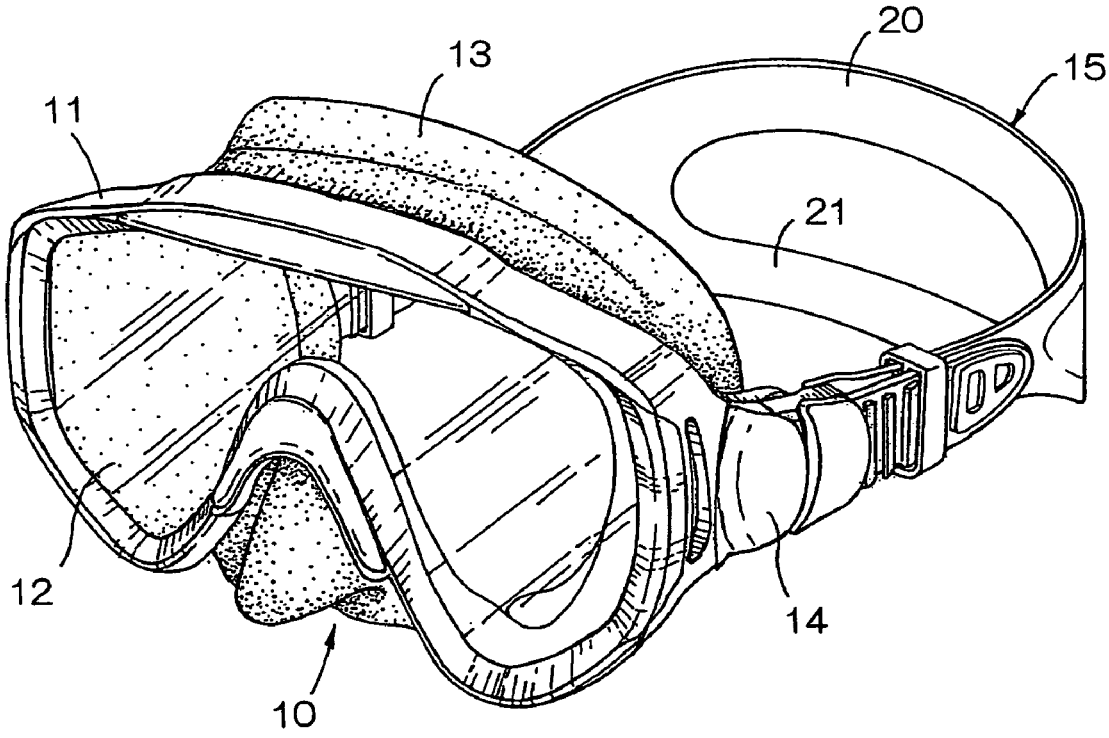
FIG. 1 is a perspective view exemplarily showing a strap according to the invention as attached to a diving face mask.

Referring to FIG. 1, a diving face mask 10 comprises a lens frame 11, a lens 12 held by the lens frame 11, a skirt 13 attached to the lens frame 11 and a strap 15 connected to both sides of the lens frame 11 by means of buckles 14.

Figure 2:
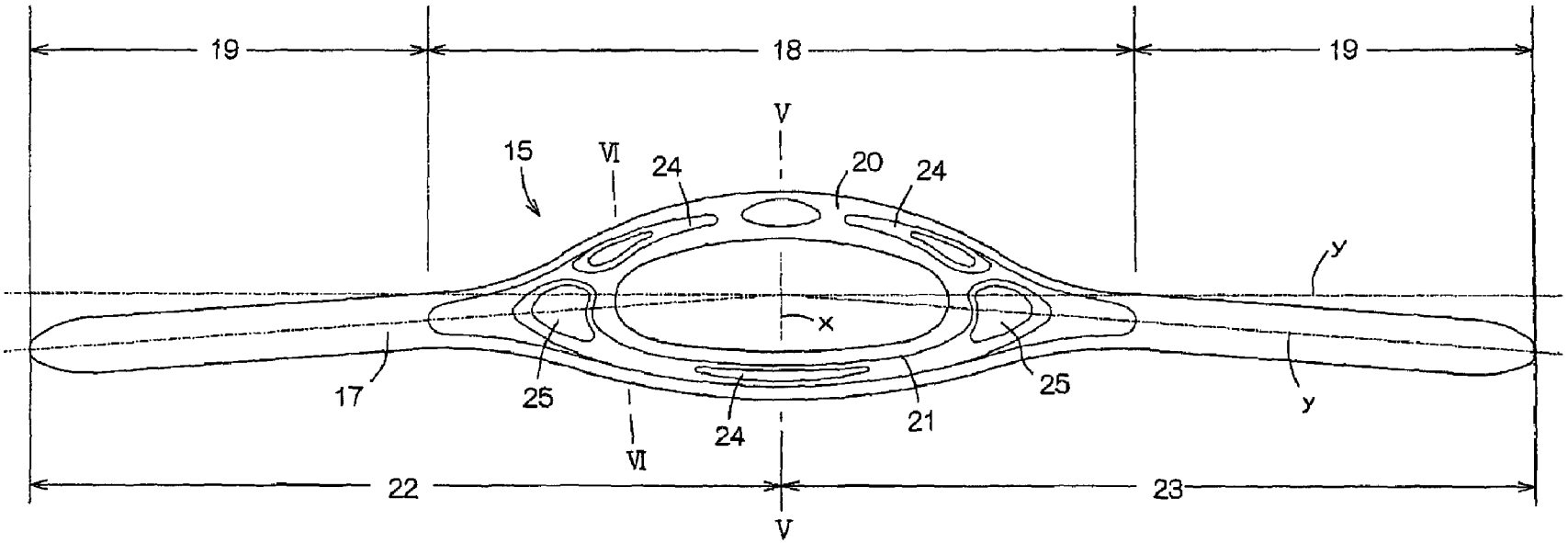
FIG. 2 is a plan view showing the strap as viewed from its outer side facing away from the wearer's head.

Referring to FIGS. 1 and 2, the strap 15 is made of a rubber or plastic material which is elastically stretchable lengthwise (in transverse direction in FIG. 2) as well as widthwise (in vertical direction in FIG. 2) and has a lengthwise axis y linearly extending lengthwise in a horizontal state as shown, a widthwise axis x, extending widthwise axis x, an inner side 16 facing the wearer's head and an outer side 17 facing away from the wearer's head. More specifically, the strap 15 further comprises a substantially elliptical loop section 18 which is relatively long lengthwise and extending in a middle zone of the strap 15 as viewed lengthwise and opposite lateral sections 19 extending lengthwise from both sides of the loop section 18. The loop section 18 comprises an upper branched sub-section 20 and a lower branched sub-section 21, which are divided by the lengthwise axis Y. The upper branched sub-section 20 has a circumferential length larger than a circumferential length of the lower branched sub-section 21. Right and left halves 22, 23 of the strap 15 divided by the widthwise axis x slope downward as viewed in FIG. 2, i.e., toward the side of the lower branched sub-section 21 along a second lengthwise axis y'. In general, a circumferential length ratio between the upper and lower branched sub-sections 20, 21 is preferably set to be 80 to 90 for the lower branched sub-section 21 on the assumption of 100 for the upper branched sub-section 20. The sloping angle, i.e., an angle at which the second lengthwise axis y' extends with respect to the first lengthwise axis y is preferably in a range of 1 to 15°.

Figure 5:
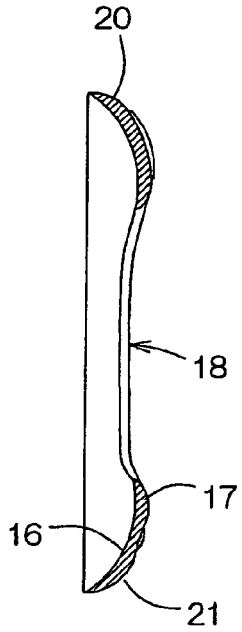
FIG. 5 is a scale-enlarged sectional view taken along the line V-V in FIG. 2.
Figure 6:
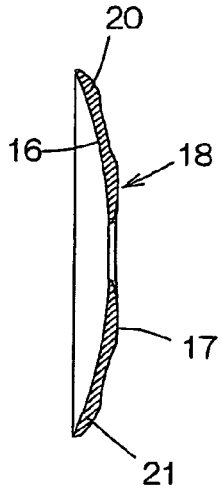
FIG. 6 is a scale-enlarged sectional view taken along the line VI-VI in FIG. 2.

As shown in FIGS. 5 and 6, the inner side 16 facing the wearer's head of the loop section 18 is three-dimensionally curved to have a concave. In other words, the loop section 18 is curved toward the outer side 17 facing away from the wearer's head (See FIG. 3). The upper and lower branched sub-sections 20, 21 of the loop section 18 are respectively provided on the outer side 17 facing away from the wearer's head with a plurality of depressed thinner regions 24 each extending lengthwise of these branched sub-sections (See FIG. 2). Opposite ends of the loop section 18 from which the upper and lower sub-sections are branched are also provided with depressed thinner regions 25 extending lengthwise and widthwise (See FIG. 2).

Figure 3:
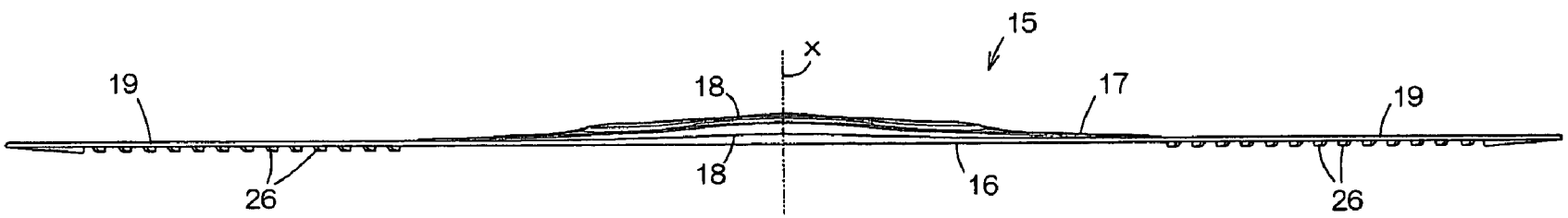
FIG. 3 is a side view showing the strap as viewed from one of its side edges.
Figure 4:
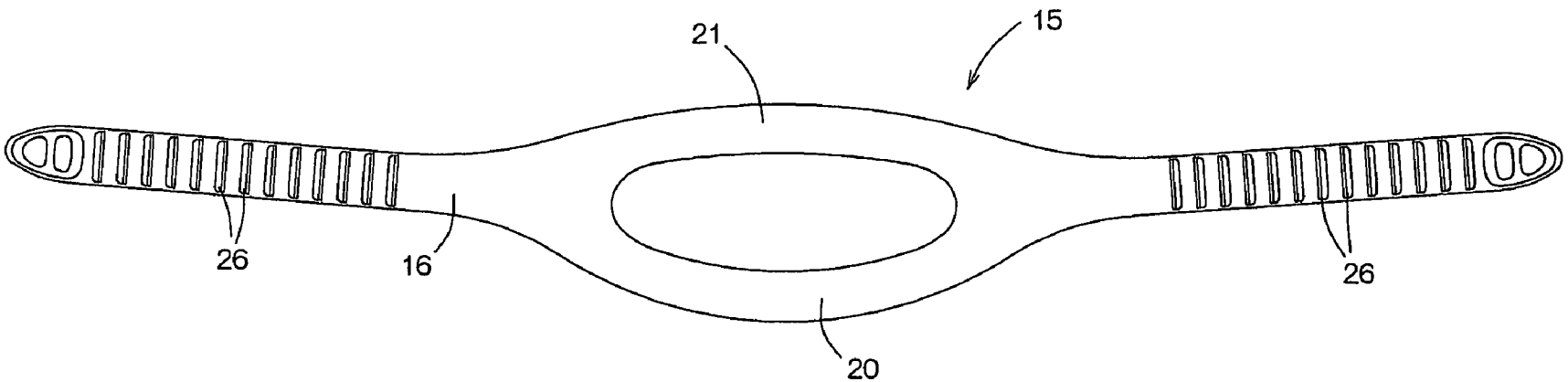
FIG. 4 is a plan view showing the strap as viewed from its inner side facing the wearer's head.

As shown in FIGS. 3 and 4, the right and left lateral sections 19 are provided on the inner side 16 facing the wearer's head with a plurality of stopper ridges 26 arranged at regular intervals lengthwise. Each of these stopper ridges 26 selected to adjust the length of the strap comes in engagement with the associated means of the respective buckles 14 (See FIG. 1) and thereby retain the length of the strap adjusted in this manner.

Figure 7:
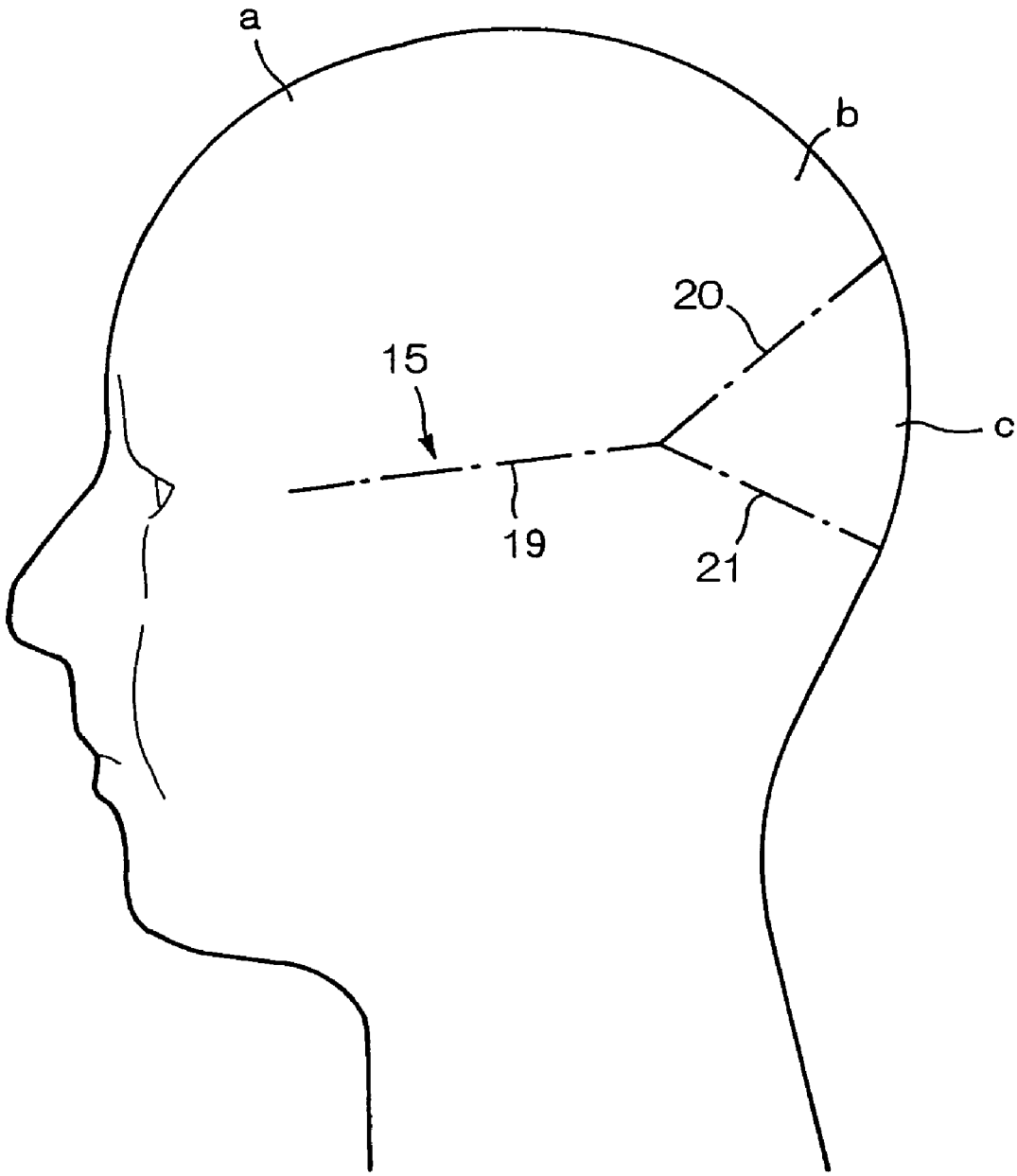
FIG. 7 is a diagram illustrating an imaginary position of the strap put on the wearer's head.
Figure 8:
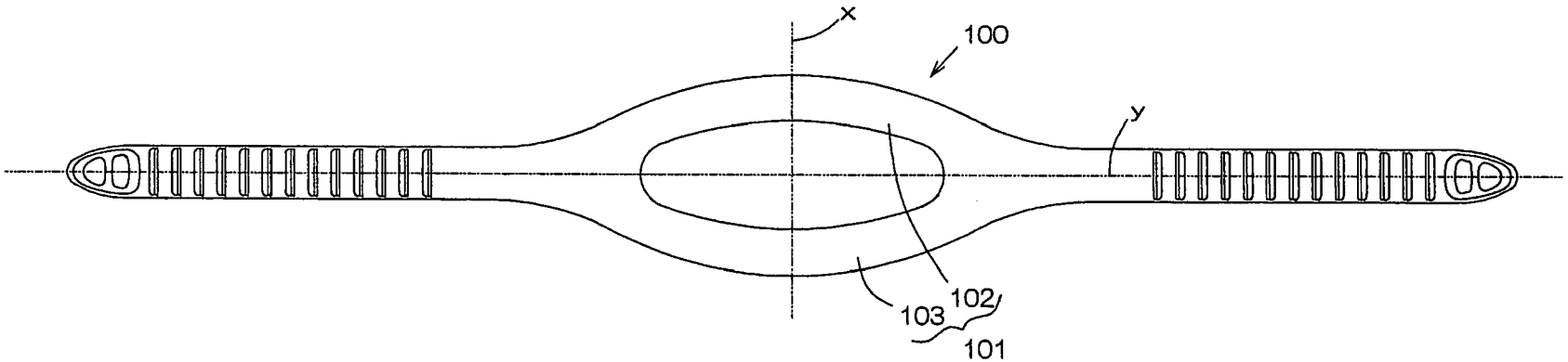
FIG.8 PRIOR ART
FIG. 8 is a plan view showing a conventional strap.

FIG. 7 exemplarily illustrates a position of the strap 15 on the occipital region b when the face mask is put on the wearer's head a. In this state, the upper branched sub-section 20 is positioned above the crowning c of the occipital region b convexly curved rearward while the lower branched sub-section 21 is positioned below the crowning c of the occipital region b. Assumed that the human's head a is divided with respect to the crowning c into the upper and lower sides, the upper side has a circumferential length larger than a circumferential length of the lower side. Taking account of this, the circumferential length of the lower branched sub-section 21 is dimensioned to be smaller than that of the upper branched sub-section 20, as has already been described. Such dimensioning effectively eliminates anxiety that, with the face mask put on the wearer's head, the lower branched sub-section 21 might become slack and/or redundant and the strap 15 as a whole might slip down as the conventional strap 100 has been the case. In this way, the fit of the strap 15 to the wearer's head a is improved. Consequentially, reliability as well as fit of the face mask 10 is correspondingly improved.

The fit of the strap 15 is further improved by making the right and left halves 22, 23 of strap 15 divided by the widthwise axis x slope toward the side of the lower branched sub-section 21 at an appropriate angle. This is because such slope cooperates with the differential circumference length to equalize the tension exerted on the upper and lower branched sub-sections 20, 21. The equalized tension ensures that the wearer might experience a feeling of discomfort due to compression locally exerted on the wearer's head when the strap 15 is put on the wearer's head.

The fit of the strap 15 is further improved also by the inner side 16 facing the wearer's head of the loop section 18 three-dimensionally curved so as to present a concave. This is because the concave of the loop section 18 comes in close contact with the curved surface of the occipital region b.

The depressed thinner regions 24, 25 provided in the loop section 18 improve not only appearance of the strap 15 but also facilitate the upper and lower branched sub-sections 20, 21 to be elastically stretched. This function also contributes to improvement in the fit of the strap 15.

While not shown, there is another embodiment providing an effect equivalent to the above-described embodiment in which the upper and lower branched sub-sections 20, 21 have a differential circumference length.

According to this embodiment, the upper branched sub-section 20 has a circumferential length substantially the same as a circumferential length of the lower branched sub-section 21. However, appropriate measures are adopted here so that it is easy for the upper branched sub-section 20 to be elastically stretched while it is difficult for the lower branched sub-section 21 to be elastically stretched. For this end, the upper branched sub-section 20 may be formed to be relatively thin while the lower branched sub-section 21 may be formed to be relatively thick or the upper branched sub-section 20 may be made of an elastically stretchable material while the lower branched sub-section 21 may be made of a stretch-resistant material. In this way, it is ensured that the upper branched sub-section 20 has its circumferential length stretched larger than that of the lower branched sub-section 21 as a tension is exerted on the strap 15.

The present invention is applicable also to the strap for the article other than the herein described face mask adapted to be put on the wearer's face such as swimming goggles, ski goggles or the like.

The entire discloses of Japanese Patent Application No. 2005-18886 filed on Jan. 26, 2005 including specification, drawings and abstract are herein incorporated by reference in its entirety.

What is claimed is:

1. A strap for diving face mask having a lengthwise axis extending lengthwise, a widthwise axis extending widthwise, an inner side facing a wearer's head, an outer side facing away from the wearer's head, a loop section defined in a middle zone thereof as viewed lengthwise and lateral sections extending from both sides of said loop section lengthwise, wherein said loop section comprises an upper branched sub-section and a lower branched sub-section which are divided by said lengthwise axis while said loop section is bilaterally symmetric with respect to a second lengthwise axis;

said upper branched sub-section has a circumferential length larger than a circumferential length of said lower branched sub-section;

wherein right and left halves of said strap divided by said widthwise axis slope toward the side of said lower branched sub-section.

2. The strap as defined by claim 1, wherein said inner side facing the wearer's head is concavely curved in said loop section as viewed in a sectional view taken widthwise.

3. The strap as defined by claim 1, wherein said upper branched sub-section and said lower branched sub-section are provided with depressed thinner regions.

4. The strap as defined by claim 1, wherein opposite ends of said loop section lengthwise are provided with depressed thinner regions.

5. The strap as defined by claim 1, wherein said strap is elastically stretchable at least lengthwise of lengthwise and widthwise.

6. A strap for diving face mask having a lengthwise axis extending lengthwise, a widthwise axis extending widthwise, an inner side facing a wearer's head, an outer side facing away from the wearer's head, a loop section defined in a middle zone thereof as viewed lengthwise and lateral sections extending from both sides of said loop section lengthwise, wherein said loop section comprises an upper branched sub-section and a lower branched sub-section which are divided by said lengthwise axis while said loop section is bilaterally symmetric with respect to a second lengthwise axis;

said upper branched sub-section has a circumferential length larger than a circumferential length of said lower branched sub-section;

wherein said inner side facing the wearer's head is concavely curved in said loop section as viewed in a sectional view taken widthwise.

7. The strap as defined by claim 6, wherein said upper branched sub-section and said lower branched sub-section are provided with depressed thinner regions.

8. The strap as defined by claim 6, wherein opposite ends of said loop section lengthwise are provided with depressed thinner regions.

9. The strap as defined by claim 6, wherein said strap is elastically stretchable at least lengthwise of lengthwise and widthwise.

10. A strap for diving face mask having a lengthwise axis extending lengthwise, a widthwise axis extending widthwise, an inner side facing a wearer's head, an outer side facing away from the wearer's head, a loop section defined in a middle zone thereof as viewed lengthwise and lateral sections extending from both sides of said loop section lengthwise, wherein said loop section comprises an upper branched sub-section and a lower branched sub-section which are divided by said lengthwise axis while said loop section is bilaterally symmetric with respect to a second lengthwise axis;

said upper branched sub-section has a circumferential length larger than a circumferential length of said lower branched sub-section;

wherein said upper branched sub-section and said lower branched sub-section are provided with depressed thinner regions.

11. The strap as defined by claim 10, wherein opposite ends of said loop section lengthwise are provided with depressed thinner regions.

12. The strap as defined by claim 10, wherein said strap is elastically stretchable at least lengthwise of lengthwise and widthwise.

13. A strap for diving face mask having a lengthwise axis extending lengthwise, a widthwise axis extending widthwise, an inner side facing a wearer's head, an outer side facing away from the wearer's head, a loop section defined in a middle zone thereof as viewed lengthwise and lateral sections extending from both sides of said loop section lengthwise, wherein said loop section comprises an upper branched sub-section and a lower branched sub-section which are divided by said lengthwise axis while said loop section is bilaterally symmetric with respect to a second lengthwise axis;

said upper branched sub-section has a circumferential length larger than a circumferential length of said lower branched sub-section;

wherein opposite ends of said loop section lengthwise are provided with depressed thinner regions.

14. The strap as defined by claim 13, wherein said strap is elastically stretchable at least lengthwise of lengthwise and widthwise.

* * * * *